US007299592B2

(12) United States Patent
Moller, Jr.

(10) Patent No.: US 7,299,592 B2
(45) Date of Patent: Nov. 27, 2007

(54) STRUCTURAL SUPPORT SYSTEM FOR FLOOR TILES

(75) Inventor: Jorgen J Moller, Jr., Salt Lake City, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 38 days.

(21) Appl. No.: 10/437,528

(22) Filed: May 14, 2003

(65) Prior Publication Data

US 2004/0226242 A1 Nov. 18, 2004

(51) Int. Cl.

| | |
|---|---|
| ***E04F 11/16*** | (2006.01) |
| ***E04F 15/00*** | (2006.01) |
| ***E04C 3/30*** | (2006.01) |
| ***E04C 3/00*** | (2006.01) |
| ***E04B 5/00*** | (2006.01) |

(52) U.S. Cl. ..... 52/180; 52/177; 52/581; 52/506.01

(58) Field of Classification Search ..... 52/177, 52/181, DIG. 5, 588.1, 581, 591, 591.3, 574, 52/650.3, 384, 386, 387, 390, 391, 392, 71, 52/389, 586.1, 747.11, 506.01, 180, 586.2, 52/592.1; 428/141, 143; 472/89, 90, 92; 404/35, 41, 47; D25/138, 157, 158, 163
See application file for complete search history.

(56) References Cited

U.S. PATENT DOCUMENTS

| | | | | |
|---|---|---|---|---|
| 3,015,136 | A * | 1/1962 | Doe | 52/663 |
| 3,093,870 | A * | 6/1963 | Brock | 52/177 |
| 3,196,763 | A * | 7/1965 | Rushton | 404/21 |
| 3,452,497 | A * | 7/1969 | Warp | 52/177 |
| 3,555,762 | A * | 1/1971 | Costanzo, Jr. | 52/588.1 |
| 3,741,411 | A * | 6/1973 | Peacock | 428/178 |
| 3,861,592 | A * | 1/1975 | Fisher | 52/177 |
| 4,133,481 | A * | 1/1979 | Bennett | 238/14 |
| 4,211,366 | A * | 7/1980 | Czarnota | 238/14 |
| 4,436,779 | A * | 3/1984 | Menconi et al. | 428/169 |
| 4,584,221 | A * | 4/1986 | Kung | 428/44 |
| 4,860,510 | A * | 8/1989 | Kotler | 52/177 |
| 4,930,286 | A * | 6/1990 | Kotler | 52/177 |
| 5,787,654 | A * | 8/1998 | Drost | 52/177 |
| 5,807,021 | A * | 9/1998 | Aaron | 52/177 |
| 5,992,106 | A * | 11/1999 | Carling et al. | 52/177 |
| 6,061,979 | A * | 5/2000 | Johannes | 52/177 |
| 6,098,354 | A * | 8/2000 | Skandis | 52/177 |
| 6,474,029 | B1 * | 11/2002 | Cook et al. | 52/223.7 |
| 6,526,705 | B1 * | 3/2003 | MacDonald | 52/177 |
| 6,751,912 | B2 * | 6/2004 | Stegner et al. | 52/177 |
| 6,802,159 | B1 * | 10/2004 | Kotler | 52/177 |
| 6,878,430 | B2 * | 4/2005 | Milewski et al. | 52/177 |

(Continued)

FOREIGN PATENT DOCUMENTS

GB 2262437 A * 6/1993

*Primary Examiner*—Richard E. Chilcot, Jr.
*Assistant Examiner*—Ryan D Kwiecinski
(74) *Attorney, Agent, or Firm*—Holland & Hart

(57) ABSTRACT

An improved support system for an injection molded floor tile is provided by vertically aligning the support system below the main floor panel with a surface structure above the main floor panel. The surface structure is at least one vertical structure or protuberance that rises above the top surface of the main floor panel. The support system maintains the structural integrity and rigidity necessary to support various loads on top of the floor tile.

26 Claims, 6 Drawing Sheets

U.S. PATENT DOCUMENTS 7,114,298 B2 * 10/2006 Kotler ..... 52/177
2002/0108323 A1 * 8/2002 Gruber ..... 52/177
2005/0072094 A1 * 4/2005 Ardern ..... 52/574
2006/0265975 A1 * 11/2006 Geffe ..... 52/177

* cited by examiner

STRUCTURAL SUPPORT SYSTEM FOR FLOOR TILES

TECHNICAL FIELD

This invention relates generally to floor tiles, and more particularly to a support system for injection molded floor tiles.

BACKGROUND OF THE INVENTION

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Floor tiles are often horizontally interconnected to one another to cover large floor areas such as a garage, an office, or a show floor.

Various interconnection systems have been utilized to connect floor tiles horizontally with one another to maintain structural integrity and provide a desirable, unified appearance. In addition, floor tiles can be manufactured in almost any shape, color, or pattern. Some floor tiles contain holes such that fluid and small debris is able to flow through the floor tiles and onto a surface below. Tiles can also be equipped with special surface patterns or structures to provide various superficial or useful characteristics. For example, a diamond steel pattern may be used to provide increased surface traction on the tiles and to provide a desirable aesthetic appearance.

One method of making plastic floor tiles utilizes an injection molding process. Injection molding involves injecting heated liquid plastic into a mold. The mold is shaped to provide an enclosed space to form the desired shaped floor tile. Next, the liquid plastic is allowed to cool thereby solidifying into the desired floor tile. Unfortunately, various problems often arise during the injection molding process that affect the final appearance of the floor tile. One prominent problem is that when the liquid plastic cools it often forms sink marks on the top surface of the floor tile. The sink marks generally coincide with the support systems located on the bottom side of the floor tile. Sink marks are caused by extra material in certain areas inside of the mold that requires additional cooling time. For example, if the bottom side of the tile contains numerous support structures, there will often be coinciding sink marks visible on the top surface of the final floor tile. The sink marks unfortunately detract from the appearance of the top surface of the floor tile. In addition, the sink marks impair the ability of the plastic floor tiles to mimic the appearance of other materials, such as metal or concrete. Throughout the life of the floor tiles, the sink marks often collect dirt and debris because they are recessed relative to the remainder of the top surface of the floor tile.

In view of the foregoing, there is a need to provide a floor tile support system that prevents sink marks from forming on the top surface of a floor tile after an injection molding process while maintaining the necessary structural integrity.

SUMMARY OF EMBODIMENTS OF THE INVENTION

The foregoing and other problems in the prior art are addressed by embodiments of the present invention, which relates to an improved support system for an injection molded floor tile that eliminates sink marks on the top surface of the floor tile. The sink marks are eliminated by vertically aligning the support system below the main floor panel with a surface structure above the main floor panel. Therefore, during the cooling process after injection molding the floor tile, the material on the top surface of the floor tile does not sink or depress because of the surface structure location. The surface structure may comprise at least one vertical structure or protuberance that rises above the top surface of the main floor panel. In addition, the support system maintains the structural integrity and rigidity necessary to support various loads on top of the floor tile.

One embodiment of the present invention pertains to an injected molded floor tile incorporating a support system that does not result in visible sink marks in the top surface of the floor tile. The floor tile includes a main floor panel, a surface structure, a support system, and a plurality of connection members. The connection members facilitate the horizontal interconnection of the floor tile with other floor tiles to cover or span large areas. The main floor panel is a solid panel extending the entire horizontal dimension of the floor tile. The surface structure is located on the top surface of the main floor panel and the support system is located on the bottom surface of the main floor panel. The surface structure rises above the main floor panel to create, for example without limitation, a diamond steel pattern that mimics a metal diamond steel plate, and provides increased traction. The support system is vertically aligned with the surface structure to avoid the formation of sink marks after the injection molding process.

The present invention provides numerous advantages over the prior art. The injection molded floor tile incorporating the support system of the present invention eliminates the formation of sink marks on the top surface of the floor tile. Sink marks detract from the aesthetic qualities of the floor tile and impair the floor tile's ability to mimic other materials such as metal. In addition, such sink marks tend to collect dirt and debris. Prior art injection molded floor tiles generally include sink marks on their top surfaces because of support structures below the main floor tile.

The foregoing features and advantages, together with other features and advantages, of the present invention, will become more apparent when referred to the following specification, claims and accompanying drawings.

BRIEF DESCRIPTION OF THE DRAWINGS

The present invention is described below with reference to the accompanying drawings.

DETAILED DESCRIPTION OF THE INVENTION

Reference will now be made to the drawings to describe various embodiments of the invention. It is to be understood that the drawings are diagrammatic and schematic representations of the embodiments, and are not limiting of the present invention, nor are they necessarily drawn to scale.

The present invention relates to an improved support system for an injection molded floor tile that eliminates sink marks on the top surface of the floor tile. The sink marks are eliminated by vertically aligning the support system below the main floor panel with a surface structure above the main floor panel. Therefore, during the cooling process after injection molding the floor tile, the material on the top surface of the floor tile does not sink or depress because of the proximity of the surface structure. The surface structure may comprise at least one vertical structure or protuberance that rises above the top surface of the main floor panel. In addition, the support system maintains the structural integrity and rigidity necessary to support various loads on top of the floor tile. Also, while embodiments of the present invention are described in the context of an improved support system for an injection molded floor tile, it will be appreciated that the teachings of the present invention are applicable to other applications as well.

Most floor tiles are manufactured with an injection molding process that introduces a liquid material into a solid mold. During the injection molding process, the liquid material is injected into the mold and then allowed to cool. The mold forms an enclosed area shaped in the form of the desired floor tile. This process can be used to manufacture any shape of floor tile with a material that can be liquefied at a particular temperature. The floor tile of the present invention comprises a plastic material that is easily liquefied at a high temperature and then cooled. It is to be understood, however, that any suitable material understood by those skilled in the art may be used. The floor tile of the present invention overcomes the prior art problem of sink marks being formed on the top surface of the floor tile during the cooling process.

Figure 1:
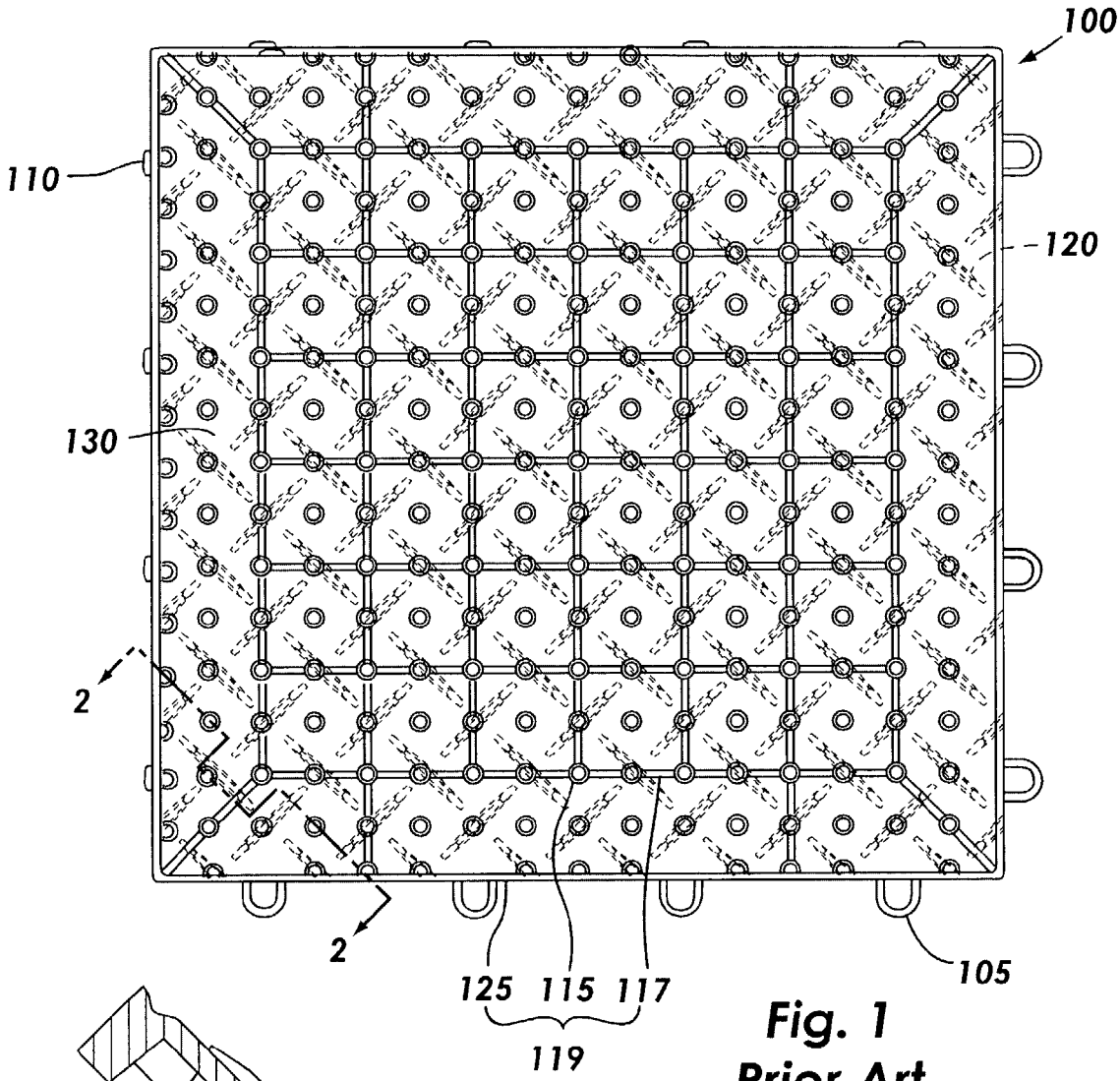
Fig. 1 Prior Art
FIG. 1 is a transparent elevation view of the bottom surface of a prior art floor tile.
Figure 2:
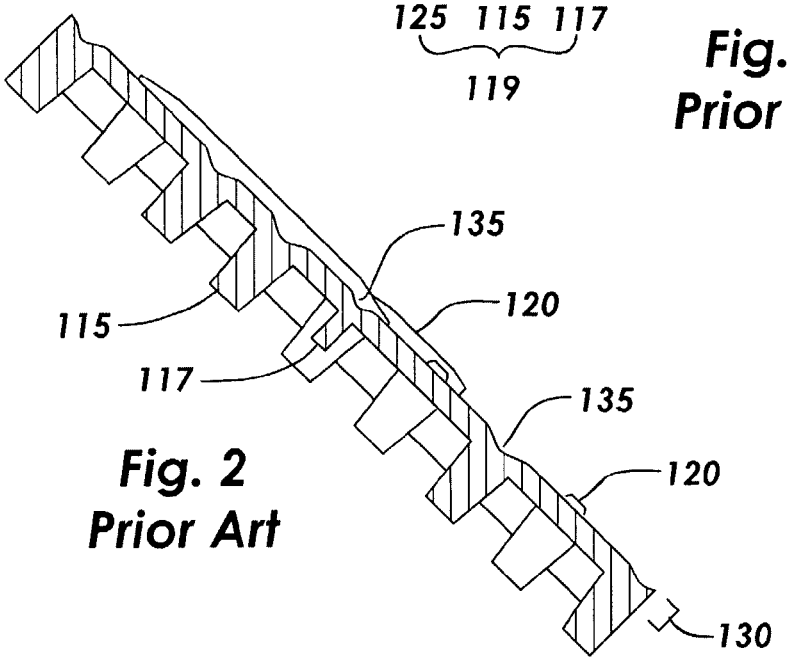
Fig. 2 Prior Art
FIG. 2 is a cross-sectional view of a portion of the prior art floor tile illustrated in FIG. 1.
Figure 3A:
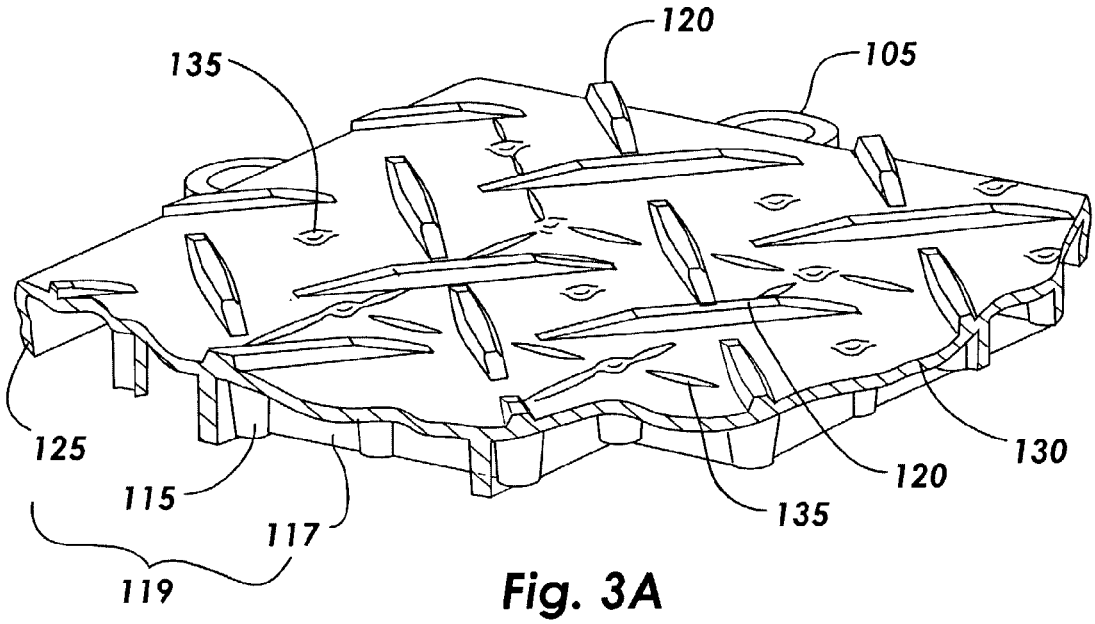
Fig. 3A Prior Art
FIG. 3A is a partial sectional perspective view of the prior art floor tile illustrated in FIG. 1.
Figure 3B:
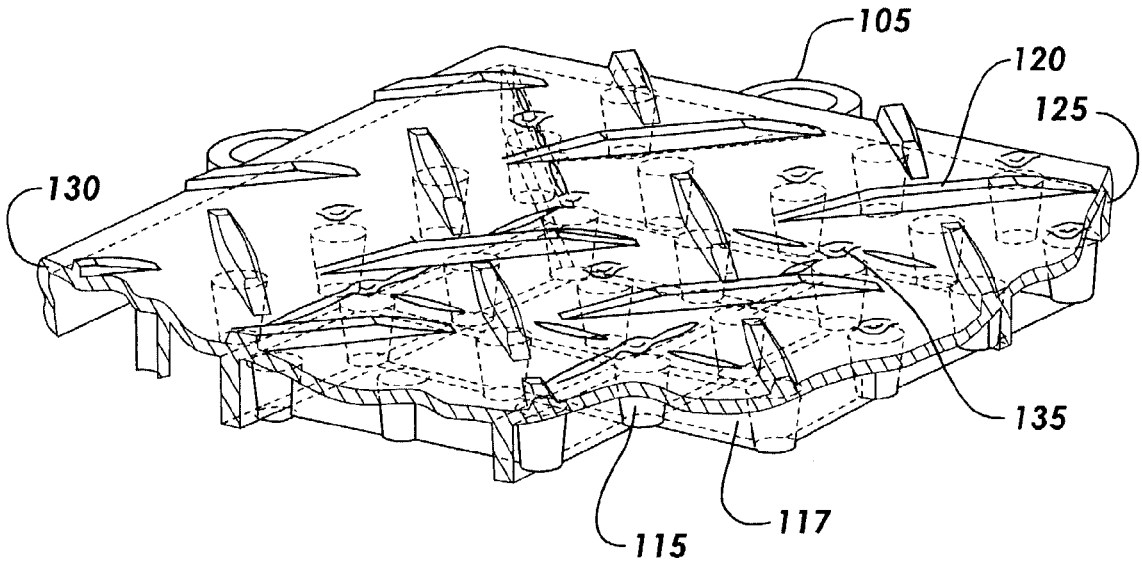
Fig. 3B Prior Art
FIG. 3B is a partial sectional transparent perspective view of the prior art floor tile illustrated in FIG. 1, including phantom lines showing the floor tile support system.

FIGS. 1-3 illustrate a prior art plastic injection molded floor tile that suffers from the sink mark problem discussed above. The prior art floor tile is designated generally at 100. FIG. 1 is a transparent elevation view of the bottom surface of the floor tile 100, FIG. 2 is a cross-sectional view of a portion of the floor tile 100 illustrated in FIG. 1, and FIGS. 3A and 3B are perspective views of the top surface of the floor tile shown in FIG. 1. The floor tile 100 includes a main floor panel 130, a surface structure 120, a support system 119, and a plurality of connection members 105, 110. The main floor panel 130 sits between the surface structure 120 and the support system 119 as shown in FIG. 2. The plurality of connection members 105, 110 are positioned on the outer edges of the floor tile 100 to facilitate horizontally connecting the floor tile 100 with other compatible floor tiles.

The main floor panel 130 is a solid structure that extends throughout the entire horizontal dimension of the floor tile 100. The surface structure 120 is positioned on the top surface of the main floor panel 130. The prior art floor tile 100 shown in FIGS. 1-3 utilizes a diamond pattern on the surface structure 120 that simulates a diamond steel surface to facilitate increased traction on top of the floor tile 100. The diamond pattern also mimics a diamond steel pattern to give a desirable aesthetic appearance. FIG. 1 illustrates the relative position of the surface structure 120 with the support system 119. The support system 119 is positioned on the bottom surface of the main floor panel 130 and is configured to support the integrity and shape of the floor tile 100. The support system 119 prevents the floor tile 100 from deforming when a heavy load is placed on top. In the illustrated floor tile 100, the support system 119 includes a sidewall 125, a plurality of support posts 115, and a plurality of support walls 117. The sidewall 125 extends around the outer edge of the bottom surface of the main floor panel 130. The support posts 115 are substantially interconnected to one another with the support walls 117 so as to form a unified support system 119 that is able to distribute forces.

As discussed above, the injection molding process often generates sink marks 135 on the top surface of the main floor panel 130 at locations corresponding to the support system 119 on the bottom surface of the main floor panel 130. FIGS. 2 and 3B shows how the sink marks 135 on the top surface of the floor tile 100 corresponds to the approximate location of the support posts 115 and support walls 117 on the bottom surface of the floor tile 100. FIG. 3A illustrates how the sink marks 135 detract from the appearance of the floor tile 100. In addition, the sink marks 135 impair the ability of the surface structure 120 to appear as though the floor tile 100 is composed of metal. Likewise, throughout the life of the floor tile 100, the sink marks 135 attract dirt and grime.

Figure 4A:
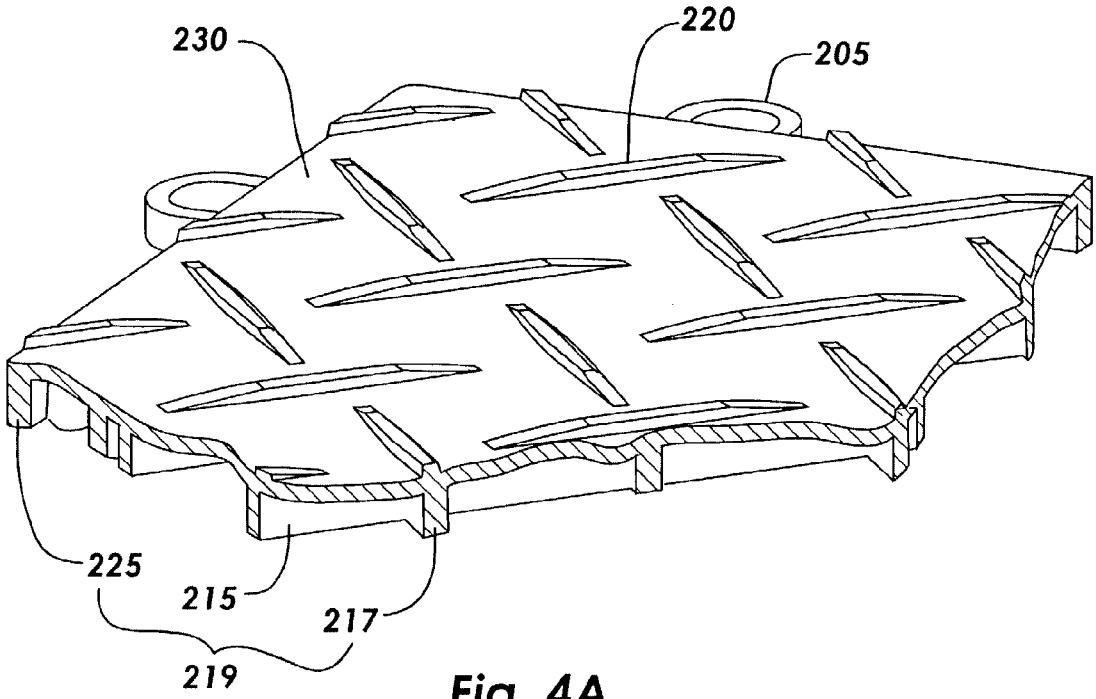
FIG. 4A is a sectional perspective view of a floor tile in accordance with one embodiment of the present invention.
Figure 4B:
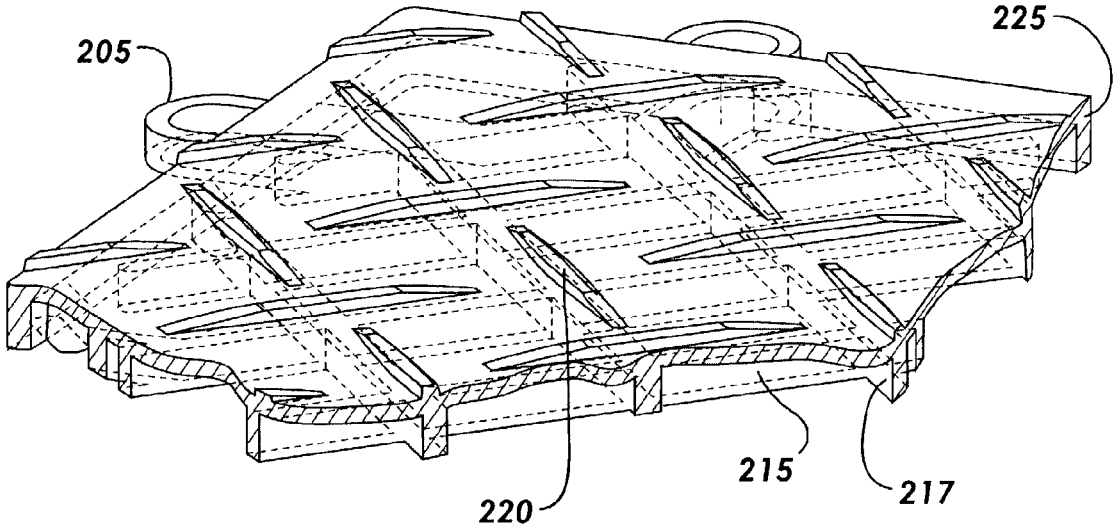
FIG. 4B is a sectional transparent perspective view of the floor tile of FIG. 4A, including phantom lines showing the support system being vertically aligned with the surface structure.
Figure 5:
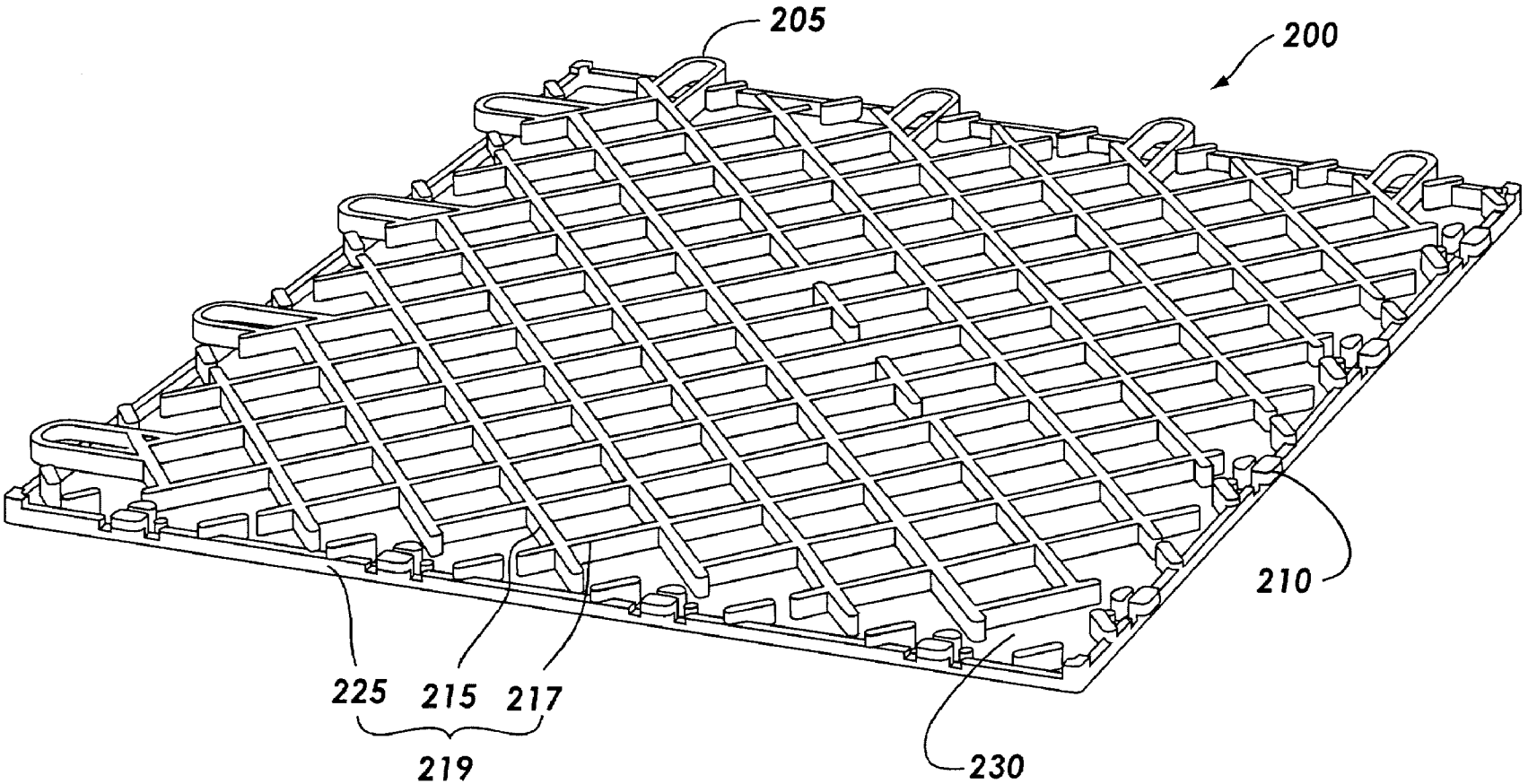
FIG. 5 is a perspective view of the bottom surface of the floor tile of FIG. 4A.

Reference is initially made to FIGS. 4A, 4B and 5, which illustrate one embodiment of a floor tile of the present invention, designated generally at 200. FIGS. 4A and 4B illustrate sectional perspective views of the top surface of the floor tile 200 and FIG. 5 illustrates a perspective view of the bottom surface of the floor tile 200. The floor tile 200 includes a main floor panel 230, a support system 219, a surface structure 220, and a plurality of connection members 205, 210. The main floor panel 230 is positioned between the support system 219 and the surface structure 220. The surface structure is shown in both FIGS. 4A and 4B while the support system 219 is shown in FIGS. 4A, 4B, and 5. The plurality of connection members 205 210 are positioned on the outer edges of the floor tile 200 to facilitate horizontally connecting the floor tile 200 with other compatible floor tiles.

The main floor panel 230 is a solid structure that extends throughout the entire horizontal dimension of the floor tile 200. The surface structure 220 is positioned on the top surface of the main floor panel 230 as shown in FIGS. 4A and 4B. The surface structure 220 rises above the main floor panel 230 by a particular amount and does not rescind into the main floor panel 230 in any way. The floor tile 200 embodiment illustrated in FIGS. 4-10 utilizes a particular type of traction system as a surface structure 220. The particular traction system utilized in the illustrated embodiments is a diamond pattern that generates an increased degree of traction on top of the floor tile 200. The diamond pattern is composed of a plurality of separate elongated diagonal protuberances extending upward from the main floor panel 230. The elongated diagonal protuberances are similar in shape and configuration to those found in a traditional diamond steel pattern and include a middle section having a generally consistent height and two side sections having a height that uniformly slopes from the middle section down to the main floor panel 230. It should be noted that other surface structures may be used without departing from the scope of this invention. For example, the surface structure 220 could include other patterns or designs that are primarily decorative rather than utilitarian, or that are more functional than a diamond pattern. In addition to providing increased traction, the diamond pattern provides a desirable aesthetic appearance.

The plurality of connection members 205, 210 facilitate the horizontal interconnection of the floor tile 200 with other floor tiles. The plurality of connection members 205, 210 are positioned on the outer lateral sides of the floor tile 200 as illustrated in FIGS. 4A, 4B, and 5. Floor tiles are generally configured to horizontally interconnect with one another so as to cover large areas without requiring individual large floor tiles to be manufactured. Smaller floor tiles can be manufactured at a significant cost savings and then be interconnected to cover the same area as an expensive large floor tile. The interconnection scheme used between the floor tiles must be significantly strong to maintain the connection when large downward forces are placed upon one or more of the individual floor tiles. In addition, the interconnection scheme must join the floor tiles tightly together without leaving large gaps between the floor tiles. The plurality of connection members 205, 210 included in the floor tile 200 further include oval male connectors 205 and oval female connectors 210. The oval male connectors 205 on the floor tile 200 are configured to interconnect with oval female connectors 210 on another floor tile and vice versa. A single oval female connector 210 comprises a hoop like rigid structure that is designed to tightly engage over an entire oval male connector 205. An oval male connector 205 comprises two rigid half circle portions that are moveable relative to one another. When the oval female connector 210 initially engages the oval male connector 205, the two rigid half circle portions of the oval male connector 205 compress towards one another allowing the hoop like rigid structure of the oval female connector 210 to completely surround the oval male connector 205. The two rigid half circle portions of the oval male connector 205 maintain a constant pressure on the oval female connector 210 thereby maintaining a secure connection between the two floor tiles. The plurality of connection members 205, 210 are positioned on the floor tile 200 such that when they engage one another the floor tiles are joined tightly together creating a consistent upper surface.

The support system 219 is positioned on the bottom surface of the main floor panel 230 and is configured to support the load place upon the tile 200, yet maintain the integrity and shape of the floor tile 200. The support system 219 is illustrated most clearly in FIG. 5 that shows the bottom surface of the floor tile 200. The support system 219 prevents the floor tile 200 from deforming when a heavy load is placed on top of the floor tile 200. In the illustrated floor tile 200, the support system 219 includes a sidewall 225, a plurality of vertical members 215, and a plurality of horizontal members 217. The sidewall 225 extends around the outer edge of the bottom surface of the main floor panel 230. The vertical members 215 and the horizontal members 217 are interconnected to form a grid structure that is capable of supporting loads on the top surface of the floor tile 200. The vertical members 215 and the horizontal members 217 are orthogonal to one another but are not necessarily truly vertically or horizontally aligned. The pattern formed by the vertical and horizontal members 215, 217 is aligned with the pattern essentially formed by the surface structure 220 as shown in FIG. 4B. If the surface structure 220 is shaped as something other than a diamond pattern, the support system would also likely be different so as to remain vertically aligned with the surface structure 220. The details of the alignment between the surface structure 220 and the support system 219 will be discussed in more detail below with reference to FIGS. 6-10.

Figure 7:
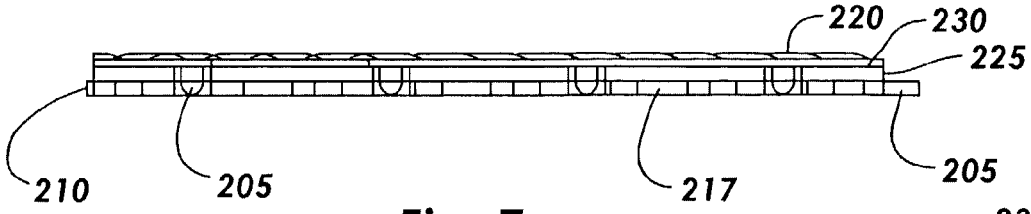
FIG. 7 is a side elevation view of the lower side of the floor tile illustrated in FIG. 6.
Figure 6:
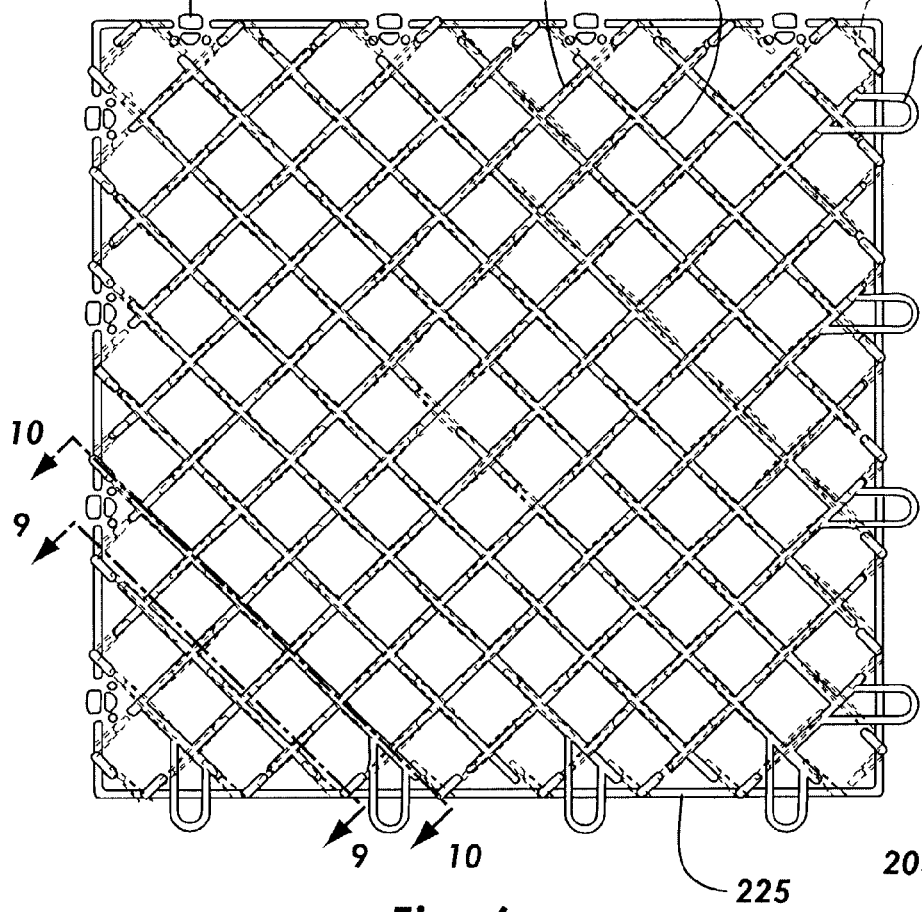
FIG. 6 is a transparent elevation view of the bottom surface of the floor tile of FIG. 4A.
Figure 8:
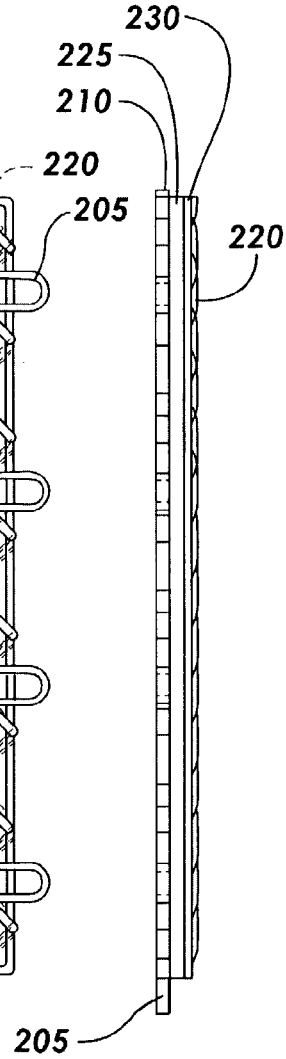
FIG. 8 is a side elevation view of the left side of the floor tile illustrated in FIG. 6.
Figure 10:
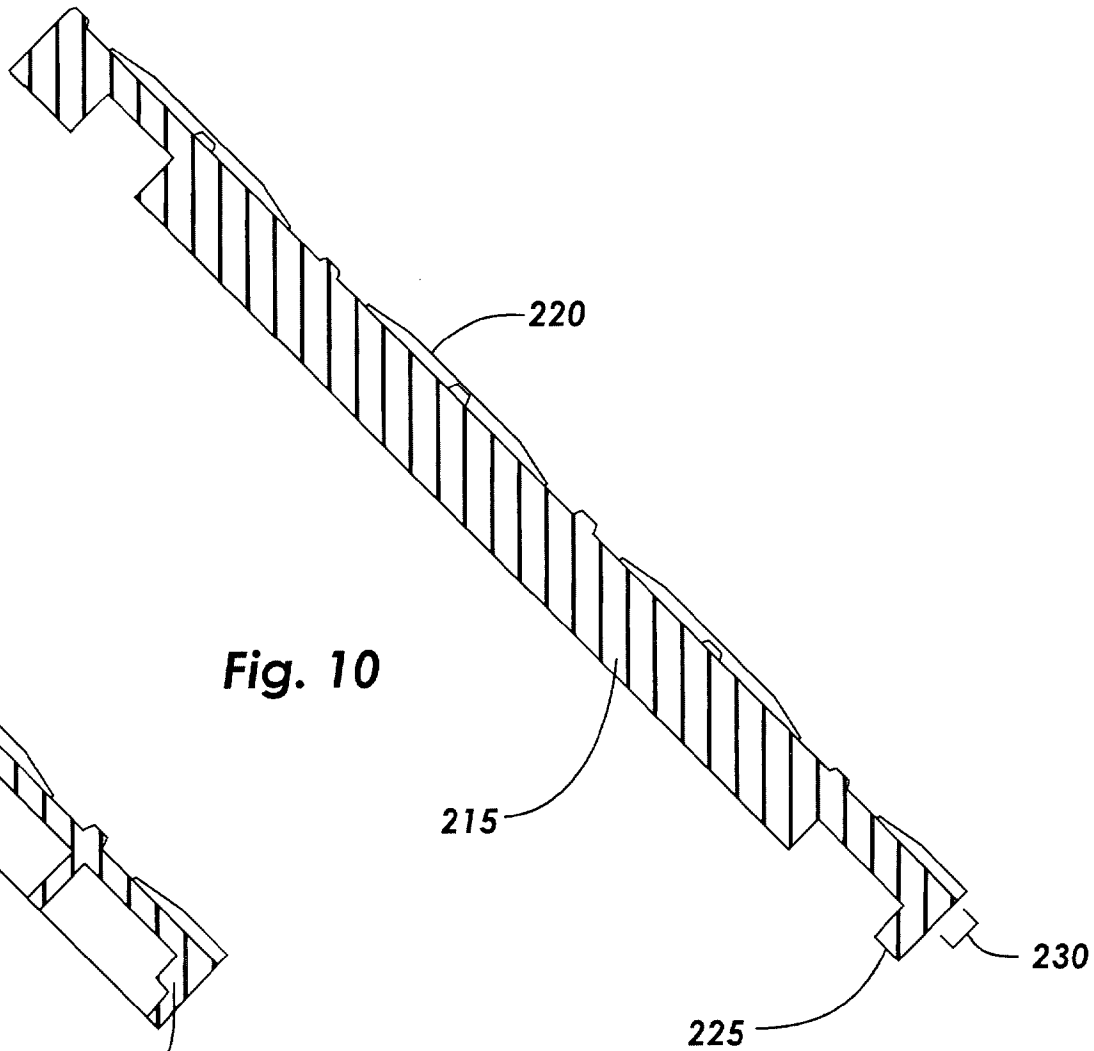
FIG. 10 is a sectional side elevation view of the floor tile illustrated in FIG. 6.
Figure 9:
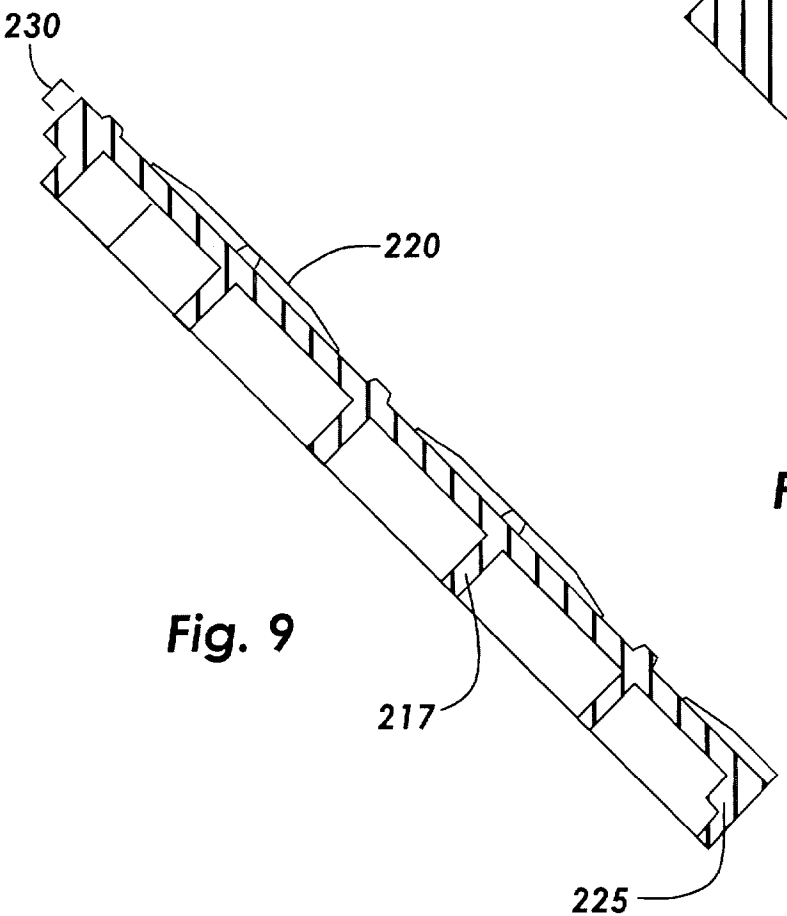
FIG. 9 is a sectional side elevation view of the floor tile illustrated in FIG. 6.

Reference is next made to FIGS. 6-10 to illustrate the alignment between the support system 219 and the surface structure 220. FIG. 6 is a transparent elevation view of the bottom surface of the floor tile 200 illustrating the support system 219 and the surface structure 220 in phantom. It is evident in FIG. 6 that the support system 219 is vertically aligned with the surface structure 220. By aligning the support system 219 in this manner, the sink mark problem identified in the prior art is eliminated. During the cooling process of injection molding, a portion of the top surface of the floor tile 200 typically rescinds down toward the support system 219 thereby forming a sink mark. By aligning the surface structure 220 and the support system 219 vertically, the excess material comprising the surface structure 220 prevents the top surface of the floor tile 200 from rescinding downward and prevents the formation of any visible sink marks. The alignment between the surface structure 220 and the support system 219 is illustrated further in FIGS. 7-10. FIGS. 7 and 8 are profile views of the lower and left sides of the floor tile 200 as illustrated in FIG. 6. FIGS. 9 and 10 are cross-sectional views of floor tile 200 as illustrated in FIG. 6.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. The words "including" and "having," as used in the specification, including the claims, shall have the same meaning as the word "comprising."

The invention claimed is:

1. An injection molded floor panel, comprising:

an at least substantially solid main floor panel;

one or more structures which extend upward from the at least substantially solid main floor panel, the one or more structures including all structures which extend upward from the at least substantially solid main floor panel; and one or more support members which extend downward from the at least substantially solid main floor panel;

wherein at least substantially all of the one or more structures are at least substantially vertically aligned with the one or more support members;

wherein an area defined by the one or more structures is contained within and positioned directly above an area defined by the one or more support members;

wherein the at least substantially solid main floor panel is continuous and solid between the one or more structures and the one or more support members; and wherein the injection molded floor panel is rigid.

2. The injection molded floor panel according to claim 1, wherein the one or more structures form a diamond plate pattern on the at least substantially solid main floor panel.

3. The injection molded floor panel according to claim 1, wherein the one or more support members include a plurality of support walls that contact an underlying surface to support the at least substantially solid main floor panel in a raised position relative to the underlying surface.

4. The injection molded floor panel according to claim 1, wherein the at least substantially solid main floor panel, the one or more structures, and the one or more support members are all made of plastic.

5. The injection molded floor panel according to claim 1, wherein the injection molded floor panel has at least four sides, the injection molded floor panel comprising a first type of connection member positioned on two of the four sides and a second type of connection member positioned on the other two of the four sides, the first type of connection member and the second type of connection member being configured to allow the injection molded floor panel to be connected to additional floor panels.

6. The injection molded floor panel according to claim 1, wherein all of the one or more structures are vertically aligned with the one or more support members.

7. An injection molded floor panel, comprising:

an at least substantially solid main floor panel;

a plurality of structures which extend upward from the at least substantially solid main floor panel, the plurality of structures including all structures which extend upward from the at least substantially solid main floor panel; and a support system which extends downward from the at least substantially solid main floor panel;

wherein at least substantially all of the plurality of structures are at least substantially vertically aligned with the support system; and wherein an area defined by each of the one or more structures is contained within and positioned directly above an area defined by the one or more support members;

wherein the support system includes a continuous section which extends underneath at least two structures from the plurality of structures.

8. The injection molded floor panel according to claim 7, comprising a plurality of connection members to facilitate joining the injection molded floor panel with additional floor panels to form a floor.

9. The injection molded floor panel according to claim 7, wherein the support system includes a plurality of support walls that extend downward from the at least substantially solid main floor panel and contact an underlying surface to support the at least substantially solid main floor panel in a raised position relative to the underlying surface.

10. The injection molded floor panel according to claim 7, wherein the plurality of structures form a diamond plate pattern ante at least substantially solid main floor panel.

11. A floor, comprising:

a plurality of at least substantially solid floor panels coupled together to form the floor, each of the at least substantially solid floor panels including a top surface having a raised design thereon; and a support system including one or more support members which extend downward from the at least substantially solid floor panel;

wherein the raised design is at least substantially vertically aligned with the support system;

wherein an area defined by each of the raised design is contained within and positioned directly above an area defined by the support system;

wherein at least one floor panel from the plurality of at least substantially solid floor panels is coupled to adjacent floor panels from the plurality of at least substantially solid floor panels so that the at least one floor panel is surrounded by the adjacent floor panels; and wherein each of the plurality of at least substantially solid floor panels is rigid.

12. The floor according to claim 11, wherein each of the plurality of substantially solid floor panels has at least four sides and comprises a first type of connection member positioned on two of the four sides and a second type of connection member positioned on the other two of the four sides, the first type of connection member and the second type of connection member being configured to allow the at least substantially solid floor panel to be connected to additional floor panels from the plurality of at least substantially solid floor panels.

13. The floor according to claim 11 wherein each of the plurality of at least substantially solid floor panels comprises a generally flat, solid surface from which the raised design extends normally.

14. A floor panel, comprising:

a top surface having a raised design thereon and a support system including one or more support members which extend downward to support the floor panel;

wherein the raised design on the top surface is at least substantially vertically aligned with the support system;

wherein an area defined by each of the raised design is contained within and positioned directly above an area defined by the support system;

wherein the raised design forms a diamond plate pattern.

15. The floor panel according to claim 14, wherein the floor panel is made of plastic.

16. An injection molded floor panel, comprising:

an at least substantially solid main floor panel including a top surface having a raised design thereon;

a support system including one or more support members which extend downward from the at least substantially solid main floor panel; and a plurality of connection members positioned to facilitate coupling of at least three sides of the injection molded floor panel to additional floor panels;

wherein the raised design is at least substantially vertically aligned with the support system;

wherein an area defined by each of the raised design is contained within and positioned directly above an area defined by the support system; and wherein the injection molded floor panel is rigid.

17. The injection molded floor panel according to claim 16, wherein the injection molded floor panel has at least four sides, and wherein the plurality of connection members include a first type of connection member positioned on two of the four sides and a second type of connection member positioned on the other two of the four sides, the first type of connection member and the second type of connection member being configured to allow the injection molded floor panel to be connected to additional floor panels.

18. The injection molded floor panel according to claim 17, wherein the first type of connection member is an oval female connector and the second type of connection member is an oval male connector.

19. An injection molded floor panel, comprising:

a main floor panel;

a plurality of structures which extend upward from the main floor panel, the plurality of structures being discontinuous and including all structures which extend upward from the main floor panel;

one or more support members which extend downward from the main floor panel; and a plurality of connection members positioned to facilitate coupling at least three sides of the injection molded floor panel to additional floor panels;

wherein at least substantially all of the plurality of structures are at least substantially vertically aligned with the one or more support members, wherein an area defined by each of the plurality of structures is contained within and positioned directly above an area defined by the one or more support members; and wherein the injection molded floor panel is rigid.

20. The injection molded floor panel according to claim 19 wherein the plurality of structures form a diamond plate pattern.

21. The injection molded floor panel according to claim 19 wherein the main floor panel is at least substantially solid.

22. The injection molded floor panel according to claim 19 wherein the injection molded floor panel has at least four sides, and wherein the plurality of connection members include a first type of connection member positioned on two of the four sides and a second type of connection member positioned on the other two of the four sides, the first type of connection member and the second type of connection member being configured to allow the injection molded floor panel to be connected to additional floor panels.

23. An injection molded floor panel, comprising:

an at least substantially solid main floor panel;

one or more structures which extend upward from the at least substantially solid main floor panel, the one or more structures including all structures which extend upward from the at least substantially solid main floor panel;

one or more support members which extend downward from the at least substantially solid main floor panel, the one or more support members including a plastic portion configured to contact an underlying surface to support the at least substantially solid main floor panel in a raised position relative to the underlying surface;

wherein at least substantially all of the one or more structures are at least substantially vertically aligned with the one or more support members;

wherein an area defined by the one or more structures is contained within and positioned directly above an area defined by the one or more support members; and wherein the injection molded floor panel is rigid.

24. The injection molded floor panel according to claim 23, wherein the plastic portion is part of a support wail that is configured to contact the underlying surface.

25. An injection molded floor panel, comprising:

a main floor panel;

a plurality of structures which extend upward from the main floor panel, the plurality of structures being discontinuous and including all structures which extend upward from the main floor panel;

one or more support members which extend downward from the main floor panel, the one or more support members including a plastic portion configured to contact an underlying surface to support the main floor panel in a raised position relative to the underlying surface;

wherein at least substantially all of the plurality of structures are at least substantially vertically aligned with the one or more support members;

wherein an area defined by each of the plurality of structures is contained within and positioned directly above an area defined by the one or more support members; and wherein the injection molded floor panel is rigid.

26. The injection molded floor panel according to claim 25, wherein the plastic portion is part of a support wall that is configured to contact the underlying surface.

* * * * *

US007299592C1

(12) EX PARTE REEXAMINATION CERTIFICATE (8283rd)

United States Patent

Moller, Jr.

(10) Number: US 7,299,592 C1

(45) Certificate Issued: May 31, 2011

(54) STRUCTURAL SUPPORT SYSTEM FOR FLOOR TILES

(75) Inventor: Jorgen J Moller, Jr., Salt Lake City, UT (US)

(73) Assignee: Jorgen J. Moller, Jr., Salt Lake, UT (US)

Reexamination Request:
No. 90/009,124, Jun. 5, 2008

Reexamination Certificate for:

| | |
|---|---|
| Patent No.: | **7,299,592** |
| Issued: | **Nov. 27, 2007** |
| Appl. No.: | **10/437,528** |
| Filed: | **May 14, 2003** |

(51) Int. Cl.

| | |
|---|---|
| ***E04F 11/16*** | (2006.01) |
| ***E04F 15/00*** | (2006.01) |
| ***E04C 3/00*** | (2006.01) |
| ***E04C 3/30*** | (2006.01) |
| ***E04B 5/00*** | (2006.01) |

(52) U.S. Cl. ..... 52/180; 52/177; 52/581; 52/506.01

(58) Field of Classification Search ..... None
See application file for complete search history.

(56) References Cited

U.S. PATENT DOCUMENTS

| | | | |
|---|---|---|---|
| 3,015,136 | A | 1/1962 | Doe |
| 3,093,870 | A | 6/1963 | Brock |
| 3,196,763 | A | 7/1965 | Rushton |
| 3,452,497 | A | 7/1969 | Warp |
| 3,555,762 | A | 1/1971 | Costanzo, Jr. |
| 3,741,411 | A | 6/1973 | Peacock |
| 3,861,592 | A | 1/1975 | Fisher |
| 4,133,481 | A | 1/1979 | Bennett |
| 4,211,366 | A | 7/1980 | Czarnota |
| 4,436,779 | A | 3/1984 | Menconi et al. |
| 4,584,221 | A | 4/1986 | Kung |
| 4,860,510 | A | 8/1989 | Kotler |
| 4,930,286 | A | 6/1990 | Kotler |
| 5,787,654 | A | 8/1998 | Drost |
| 5,807,021 | A | 9/1998 | Aaron |
| 5,992,106 | A | 11/1999 | Carling et al. |
| 6,015,053 | A | 1/2000 | Sheng |
| 6,061,979 | A | 5/2000 | Johannes |
| 6,098,354 | A | 8/2000 | Skandis |
| D456,533 | S | 4/2002 | Moller, Jr. |
| 6,526,705 | B1 | 3/2003 | MacDonald |
| 6,751,912 | B2 | 6/2004 | Stegner et al. |
| 6,802,159 | B1 | 10/2004 | Kotler |
| 6,878,430 | B2 | 4/2005 | Milewski et al. |
| 7,114,298 | B2 | 10/2006 | Kotler |
| 7,299,592 | B2 | 11/2007 | Moller, Jr. |
| 2002/0108323 | A1 | 8/2002 | Gruber |
| 2005/0072094 | A1 | 4/2005 | Ardern |
| 2006/0265975 | A1 | 11/2006 | Geffe |

FOREIGN PATENT DOCUMENTS

| | | | |
|---|---|---|---|
| GB | 2 262 437 | A | 12/1991 |

OTHER PUBLICATIONS

P.S. Cracknell and R.W. Dyson, Handbook of Thermoplastics Injection Mould Design, Chapman & Hall; p. 8, 1993.

Tim A. Osswald, Lih–Sheng (Tom) Turng; and Paul J. Gramann; Injection Molding Handbook, Carl Hanser Verlag, pp. 597–598, 2002.

James M. Margolis; Engineering Thermoplastics, Properties and Applications, Marcel Dekker, Inc., 1985.

*Primary Examiner*—Aaron J. Lewis

(57) ABSTRACT

An improved support system for an injection molded floor tile is provided by vertically aligning the support system below the main floor panel with a surface structure above the main floor panel. The surface structure is at least one vertical structure or protuberance that rises above the top surface of the main floor panel. The support system maintains the structural integrity and rigidity necessary to support various loads on top of the floor tile.

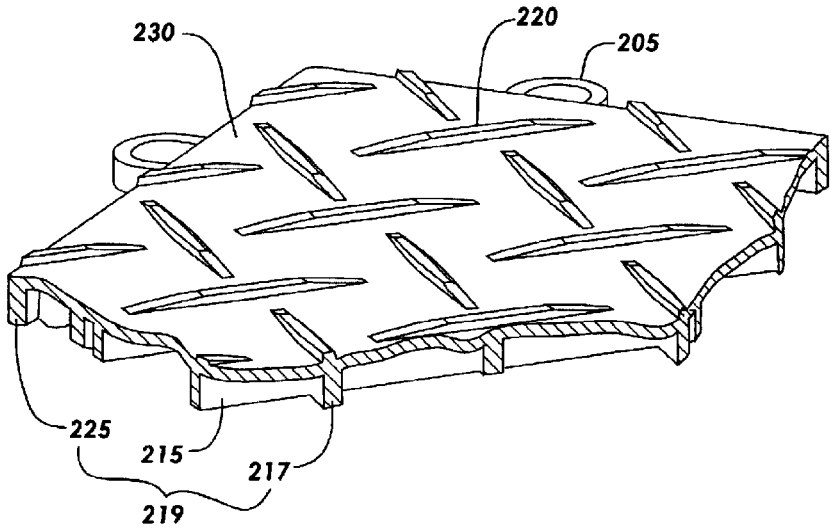

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, line 58 to column 5, line 17:

The main floor panel 230 is a solid structure that extends throughout the entire horizontal dimension of the floor tile 200. The surface structure 220 is positioned on the top surface of the main floor panel 230 as shown in FIGS. 4A and 4B. The surface structure 220 rises above the main floor panel 230 by a particular amount and does not rescind into the main floor panel 230 in any way. The floor tile 200 embodiment illustrated in FIGS. 4-10 utilizes a particular type of traction system as a surface structure 220. The particular traction system utilized in the illustrated embodiments is a diamond pattern that generates an increased degree of traction on top of the floor tile 200. The diamond pattern is *a discontinuous pattern* composed of a plurality of separate elongated diagonal protuberances extending upward from the main floor panel 230. *Each of the plurality of protuberances is positioned perpendicular to adjacent protuberances as shown in FIGS. 4A and 4B.* The elongated diagonal protuberances are similar in shape and configuration to those found in a traditional diamond steel pattern and include a middle section having a generally consistent height and two side sections having a height that uniformly slopes from the middle section down to the main floor panel 230. It should be noted that other surface structures may be used without departing from the scope of this invention. For example, the surface structure 220 could include other patterns or designs that are primarily decorative rather than utilitarian, or that are more functional than a diamond pattern. In addition to providing increased traction, the diamond pattern provides a desirable aesthetic appearance.

AS A RESULT OF REEXAMINATION, IT HAS BEEN DETERMINED THAT:

Claims 1, 7, 10, 11, 14, 16, 19, 23 and 25 are determined to be patentable as amended.

Claims 2-6, 8, 9, 12-13, 15, 17-18, 20-22, 24 and 26, dependent on an amended claim, are determined to be patentable.

New claim 27 is added and determined to be patentable.

1. An injection molded floor panel, comprising:

an at least substantially solid main floor panel;

one or more structures which extend upward from the at least substantially solid main floor panel, the one or more structures including all structures which extend upward from the at least substantially solid main floor panel; and one or more support members which extend downward from the at least substantially solid main floor panel;

wherein at least substantially all of the one or more structures are at least substantially vertically aligned with the one or more support members;

wherein an area defined by *each of* the one or more structures is contained within and positioned directly above an area defined by the one or more support members, *the area defined by each of the one or more structures is the entire area of the structure that extends upward from the at least substantially solid main floor panel;*

*wherein the one or more structures form a discontinuous pattern of separate, elongated protrusions*;

wherein the at least substantially solid main floor panel is continuous and solid between the one or more structures and the one more support members; and wherein the injection molded floor panel is rigid.

7. An injection molded floor panel, comprising:

an at least substantially solid main floor panel;

a plurality of structures which extend upward from the at least substantially solid main floor panel, the plurality of structures including all structures which extend upward from the at least substantially solid main floor panel; and a support system which extends downward from the at least substantially solid main floor panel;

wherein at least substantially all of the plurality of structures are at least substantially vertically aligned with the support system; [and]

wherein an area defined by each of the [one or more] *plurality of* structures is contained within and positioned directly above an area defined by the one or more support members;

*wherein the plurality of structures form a discontinuous pattern of separate, elongated protrusions; and* wherein the support system includes a continuous section which extends underneath at least two structures from the plurality of structures.

10. The injection molded floor panel according to claim 7, wherein the plurality of structures form a diamond plate pattern [ante] *on the* at least substantially solid main floor panel.

11. A floor, comprising:

a plurality of at least substantially solid floor panels coupled together to form the floor, each of the at least substantially solid floor panels including a top surface having a raised design thereon; and a support system including one or more support members which extend downward from the at least substantially solid floor panel;

wherein the raised design is at least substantially vertically aligned with the support system;

wherein an area defined by each *protrusion* of the raised design is contained within and positioned directly above an area defined by the support system;

*wherein the raised design forms a discontinuous pattern of separate, elongated protrusions:* wherein at least one floor panel from the plurality of at least substantially solid floor panels is coupled to adjacent floor panels from the plurality of at least substantially solid floor panels so that the at least one floor panel is surrounded by the adjacent floor panels; and wherein each of the plurality of at least substantially solid floor panels is rigid.

14. A floor panel, comprising:

a top surface having a raised design thereon and a support system including one or more support members which extend downward to support the floor panel;

wherein the raised design on the top surface is at least subtantially vertically aligned with the support system;

wherein an area defined by each *protrusion* of the raised design is contained within and positioned directly above an area defined by the support system;

wherein the raised design [forms] *includes separate, elongated protrusions which form* a diamond plate pattern.

16. An injection molded floor panel, comprising:

an at least substantially solid main floor panel including a top surface having a raised design thereon;

a support system including one or more support members which extend downward from the at least substantially solid main floor panel; and a plurality of connection members positioned to facilitate coupling of at least three sides of the injection molded floor panel to additional floor panels;

wherein the raised design is at least substantially vertically aligned with the support system;

wherein an area defined by each *protrusion* of the raised design is contained within and positioned directly above an area defined by the support system; [and]

*wherein the raised design forms a discontinuous pattern of separate, elongated protrusions; and* wherein the injection molded floor panel is rigid.

19. An injection molded floor panel, comprising:

a main floor panel;

a plurality of structures which extend upward from the main floor panel, the plurality of structures being discontinuous and including all structures which extend upward from the main floor panel;

one or more support members which extend downward from the main floor panel; and a plurality of connection members positioned to facilitate coupling at least three sides of the injection molded floor panel to additional floor panels;

wherein at least substantially all of the plurality of structures are at least substantially vertically aligned with the one or more support members, wherein an area defined by each of the plurality of structures is contained within and positioned directly above an area defined by the one or more support members; [and]

*wherein the plurality of structures form a discontinuous pattern of separate, elongated protrusions; and* wherein the injection molded floor panel is rigid.

23. An injection molded floor panel, comprising:

an at least substantially solid main floor panel;

one or more structures which extend upward from the at least substantially solid main floor panel, the one or more structures including all structures which extend upward from the at least substantially solid main floor panel;

one or more support members which extend downward from the at least substantially solid main floor panel, the one or more support members including a plastic portion configured to contact an underlying surface to support the at least substantially solid main floor panel in a raised position relative to the underlying surface;

wherein at least substantially all of the one or more structures are at least substantially vertically aligned with the one or more support members;

wherein an area defined by *each of* the one or more structures is contained within and positioned directly above an area defined by the one or more support members; [and]

*wherein the one or more structures form a discontinuous pattern of separate, elongated protrusions; and* wherein the injection molded floor panel is rigid.

25. An injection molded floor panel, comprising:

a main floor panel;

a plurality of structures which extend upward from the main floor panel, the plurality of structures being discontinuous and including all structures which extend upward from the main floor panel;

one or more support members which extend downward from the main floor panel, the one or more support members including a plastic portion configured to contact an underlying surface to support the main floor panel in a raised position relative to the underlying surface;

wherein at least substantially all of the plurality of structures are at least substantially vertically aligned with the one or more support members;

wherein an area defined by each of the plurality of structures is contained within and positioned directly above an area defined by the one or more support members; [and]

*wherein the plurality of structures form a pattern of separate, elongated protrusions each of which is positioned perpendicular to adjacent ones of the separate, elongated protrusions; and* wherein the injection molded floor panel is rigid.

*27. The injection molded floor panel of claim 1 wherein the one or more support members are interconnected to form a grid structure that extends underneath all of the one or more structures.*

* * * * *